United States Patent [19]

Rolff

[11] 4,128,936

[45] Dec. 12, 1978

[54] METHOD FOR THE MANUFACTURE OF CONTACTS FOR GAS-BLAST CIRCUIT BREAKERS

[75] Inventor: Klaus-Peter Rolff, Berlin, Germany

[73] Assignee: Siemens Aktiengesellschaft, Berlin and Munich, Germany

[21] Appl. No.: 797,480

[22] Filed: May 16, 1977

[30] Foreign Application Priority Data

Jun. 10, 1976 [DE] Fed. Rep. of Germany ..... 2626246

[51] Int. Cl.[2] ..... H01R 9/00

[52] U.S. Cl. ..... 29/630 R; 29/416; 156/309

[58] Field of Search ..... 29/630 R, 592, 412, 29/416, 469.5; 156/309, 250, 264, 266

[56] References Cited

U.S. PATENT DOCUMENTS

| | | | |
|---|---|---|---|
| 2,636,851 | 4/1953 | Suggs et al. | 29/630 R |
| 2,979,814 | 4/1961 | Steinberg | 156/309 X |
| 3,616,039 | 10/1971 | Hutzler | 156/309 |
| 4,023,079 | 5/1977 | Selover, Jr. et al. | 156/309 X |

*Primary Examiner*—Leon Gilden

*Attorney, Agent, or Firm*—Kenyon & Kenyon, Reilly, Carr & Chapin

[57] ABSTRACT

A method for manufacturing a contact for use with a gas-blast circuit breaker wherein the contact has slots in an end face which are filled with an arc-resistant plastic material and wherein the method comprises the steps of forming a plurality of contact members and cementing the members together employing an arc-resistant plastic to form a structural unit.

5 Claims, 2 Drawing Figures

METHOD FOR THE MANUFACTURE OF CONTACTS FOR GAS-BLAST CIRCUIT BREAKERS

BACKGROUND OF THE INVENTION

1. Field of the invention

The invention relates to a method for making contacts for use with a gas-blast circuit breaker.

2. Description of the Prior Art

German Offenlegungsschrift No. 2,215,929 discloses a contact system for use with a gas-blast circuit breaker wherein an arc is drawn in the gap between the contacts when the breaker is interrupted under load. The aforesaid contact system is further provided with means for providing magnetic forces which accelerate formation of the arc independently of the pressurized-gas flow which is set in motion during the interruption process. The aforesaid means is in the form of slots arranged in the end faces of the contacts. These slots, in turn, are formed by recesses which initially run level and then at an angle to the axis of the contacts so as to enter the inner opening of the contacts tangentially. In this manner, the quantity of quenching gas which is carried into the gap between the two contacts during the interrupting process of the breaker is better utilized. Also to prevent the slots from disturbing the gas flow in the vicinity of the end faces of the contacts, the slots are filled with an arc-resistant insulating material.

Typically, the above-described contact system is manufactured by using material removing tools, such as milling or sawing tools, to form slots along a portion the length of each electrode and by placing an arc-resistent insulating material in the aforesaid slots.

It is an object of the present invention to provide a method for making the above-described contacts in a simpler and more economical manner.

SUMMARY OF THE INVENTION

In accordance with the principles of the present invention the above and other objectives are accomplished in a method whererin a plurality of contact members are first formed and, thereafter, the contact members are cemented together employing an arc-resistant plastic material to form a structural unit.

The method of the invention can be advantageously carried out in such a manner that the contact members are formed by sawing or cutting up a contact blank. The formed contact members are then coated with an arc-resistant plastic on corresponding facing surfaces and, thereafter, placed in contact. The arc-resistant plastic material employed in the method of the invention can, advantageously, have inclined therein at least one electrically conductive additive material, in order to ensure an equipotential surface free of edges at the contact surfaces. Furthermore, also, advantageously, the arc-resistant plastic may be a casting resin which has favorable adhesion properties and the individual contact members may comprise graphite.

BRIEF DESCRIPTION OF THE DRAWINGS

The above and other features and aspects of the present invention will become more apparent upon reading the following detailed description in conjunction with the accompanying drawings in which.

DETAILED DESCRIPTION

Figure 1:
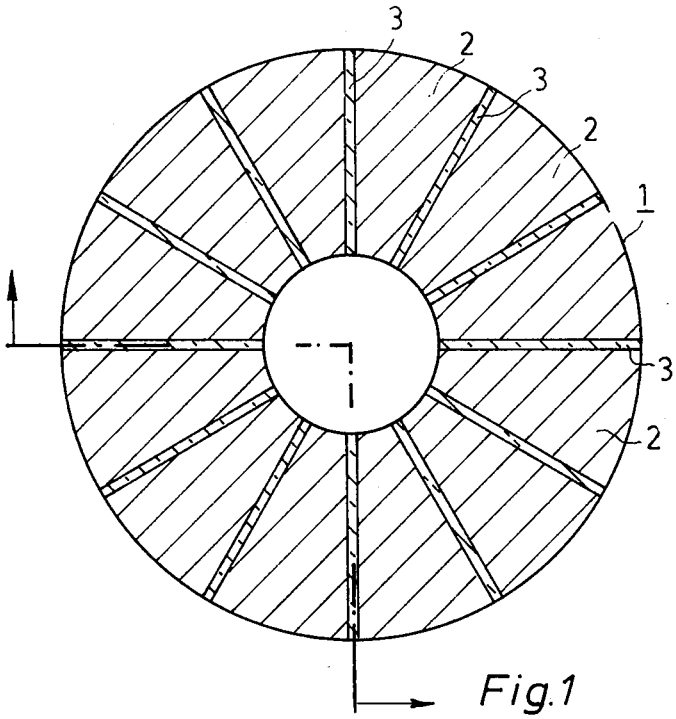
FIGS. 1 and 2 illustrate two corresponding views of a contact system made in accordance with the method of the present invention.
Figure 2:
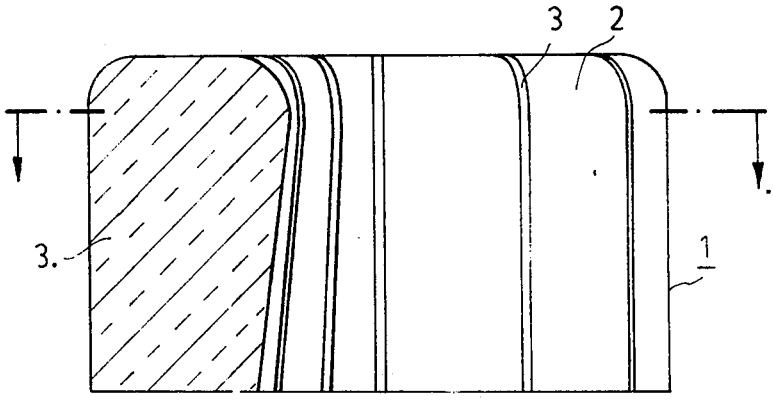

FIGS. 1 and 2 illustrate corresponding views of a nozzle-shaped contact arrangement 1 for use with a gas-blast circuit breaker; the aforesaid contact arrangement having been manufactured according to the method of the present invention. More particularly, as can be seen from the axial cross section view of FIG. 1, the nozzle-shaped contact arrangement 1 includes a plurality of electrically conducting contact members 2, each of which is formed by sawing or cutting off a segment of a contact blank whose outer and inner surfaces are contoured to give the blank the shape of a nozzle. The individual contact members 2, after formation, are then cemented together contacting adjacent surfaces of the members after applying an arc-resistant plastic material to the surfaces. More particularly, when the plastic material solidifies, the contact members 2 become cemented together and the structural contact arrangement or unit 1 results. As can be seen, the solidified plastic material forms radially outwardly directed thin barriers 3 in the finished contact.

In order to obtain an equipotential surface without edges at the outer contours of the nozzle-shaped contact so formed, the arc-resistant plastic material which forms the barriers 3 can be mixed with at least on electrically conductive additive material, e.g., powdered graphite. Furthermore, if the barriers 3 are of less width than the saw cuts in the contact members 2, the contact 1 can be brought into the desired form by turning or milling after the plastic is solidified.

A preferred form for an arc-resistant plastic which is mixed with an electrically conductive additive and is suited as an adhesive for the cementing of the contact members 2, comprises the following:

100 parts cycloaliphatic epoxy resin with an epoxy number of about 1.5;

35 parts succinic acid anhydride (hardener); and 40 parts of a reactive softener, e.g., an acid ester of succinic acid and Castor oil;

2–3 parts accelerator (e.g., sodium glycolate); and 100 parts fine graphite powder 99.5 to 99.9.

The contact members 2 may be formed from graphite. In such case, the members exhibit advantageous burn-off properties which make the contact particularly well suited for use with pressurized-gas power circuit breakers and, in particular, blast piston ("puffer") circuit breakers which have insulation comprising $SF_6$ gas and pressurized-gas flow.

What is claimed is:

1. A method of manufacturing a nozzle-shaped contact, said contact being used in a pressurized-gas circuit breaker and having slots in its end face and arc-resistant plastic material inserted in said slots, the method comprising:

forming a plurality of contact members, said contact members each having two outer surfaces;

and cementing each outer surface of each of said members to the outer surface of an adjacent member with an arc-resistant plastic material to form a closed body having a bore therethrough.

2. A method in accordance with claim 1 wherein: said arc-resistant plastic material includes at least one electrically conductive additive material.

3. A method in accordance with claim 1 wherein: said forming of said contact members comprises one of sawing-up and cutting up a contact blank.

4. A method in accordance with claim 1 wherein said arc-resistant plastic material is a casting resin.

5. A method in accordance with claim 1 wherein: said contact members each comprise graphite.

* * * * *